United States Patent [19]

Linde et al.

[11] 4,356,013

[45] Oct. 26, 1982

[54] SPLIT PRESSURE FEED FOR THE SELECTIVE PRODUCTION OF PURE OXYGEN FROM AIR

[75] Inventors: Gerhard Linde; Guenter Rueckborn, both of Gruenwald, Fed. Rep. of Germany

[73] Assignee: Linde Aktiengesellschaft, Wiesbaden, Fed. Rep. of Germany

[21] Appl. No.: 116,195

[22] Filed: Jan. 28, 1980

[30] Foreign Application Priority Data

Jan. 26, 1979 [DE] Fed. Rep. of Germany ..... 2903089

[51] Int. Cl.[3] ..... F25J 3/04

[52] U.S. Cl. ..... 62/13; 62/29; 62/38

[58] Field of Search ..... 62/13–15, 62/29, 30, 31

[56] References Cited

U.S. PATENT DOCUMENTS

| | | | |
|---|---|---|---|
| 2,040,107 | 5/1936 | Schlitt | 62/30 |
| 2,664,719 | 1/1954 | Rice et al. | 62/29 |
| 2,873,583 | 2/1959 | Potts et al. | 62/30 |
| 4,254,629 | 3/1981 | Olszewski | 62/38 |

FOREIGN PATENT DOCUMENTS 1069576 5/1967 United Kingdom .

*Primary Examiner*—Norman Yudkoff
*Attorney, Agent, or Firm*—Millen & White

[57] ABSTRACT

In the obtaining of oxygen from air by low-temperature rectification in a double rectification column by compressing the air to be fractionated into higher and lower pressure partial streams; cooling said partial streams in indirect heat exchange with a nitrogen-enriched gaseous stream from the rectification column; and introducing the partial stream of the air to be fractionated which has been compressed to the higher pressure into the lower part of the high pressure column, the improvement of passing at least a part of the partial stream of the air to be fractionated which has been compressed to the lower pressure to a supplemental fractionating column operating at between the pressure ambient in the high-pressure column and the pressure ambient in the low-pressure column, withdrawing from said supplemental column a nitrogen-enriched liquid, passing the latter as reflux to the low-pressure column, engine expanding the remaining portion of the partial stream compressed to the lower pressure and/or a gaseous stream withdrawn from the supplemental fractionating column and introducing resultant engine expanded fluid in a substantially gaseous phase into the low-pressure column.

19 Claims, 3 Drawing Figures

SPLIT PRESSURE FEED FOR THE SELECTIVE PRODUCTION OF PURE OXYGEN FROM AIR

BACKGROUND OF THE INVENTION

This invention relates to a process for obtaining oxygen from air by two-stage low-temperature rectification, using a high-pressure column and a low-pressure column. In particular, this invention comprises improvements in a process wherein the air to be fractionated is separated into two partial streams of different pressures; these partial streams are cooled in two separate heat-exchange units in heat exchange with a nitrogen-enriched gaseous stream from the rectification; and the partial stream of the air to be fractionated which has been compressed to the higher pressure is introduced into the lower portion of the high pressure column. A process of this type has been disclosed in German Pat. No. 1,259,363, corresponding to British Pat. No. 1,069,576.

The above-described process method results in the economic production of approximately equal amounts of 70% oxygen on the one hand, and "pure" oxygen on the other hand. A portion of the feed air, in this process, is compressed to a relatively low pressure (about 2.2 bar), liquefied in heat exchange with an oxygen-enriched preliminary fractionation liquid, and a small part of the thus liquefied feed is fed to the low-pressure column. Conversely, the largest part of the liquefied feed is introduced into the high-pressure column where a corresponding flow is withdrawn from above the feed point and then conducted to the low-pressure column. A second portion of the entering air is compressed to a pressure of about 5.8 bar and fed to the high-pressure column. Finally, another air stream is compressed to a relatively high pressure (about 15 bar), freed of water and carbon dioxide in an adsorber stage, partially cooled in heat exchange with nitrogen from the high-pressure column, and then introduced into said column. The resultant warmed nitrogen from the aforesaid heat exchange step is engine-expanded in a turbine and thereafter warmed in heat exchange with entering air and discharged from the plant.

The above-described process, in view of the resultant production of approximately equal amounts of impure and "pure" oxygen, is uneconomical if a large demand exists for "pure" oxygen, i.e. having a purity of at least 95%, especially 95–98% oxygen, as required, for example, in the gasification of heavy oil or coal and with no concomitant demand for impure oxygen, i.e. about 70% purity.

SUMMARY OF THE INVENTION

A principal object of this invention is to provide a process of the above type, but which is also economically attractive even when there is a high requirement for pure oxygen.

Another object is to provide apparatus for this improved process.

Upon further study of the specification and appended claims, further objects and advantages of this invention will become apparent to those skilled in the art.

To attain these objects, at least a part of that partial stream of the air to be fractionated which has been compressed to the lower pressure is introduced into a further fractionating column operated between the pressure ambient in the high-pressure column and the pressure ambient in the low-pressure column, from which further fractionating column a nitrogen-enriched liquid is withdrawn and fed as reflux to the low-pressure column. Further improvement is obtained by providing that the remaining part of partial stream compressed to the lower pressure and/or a gaseous stream withdrawn from the further column is engine-expanded and introduced essentially in the gaseous phase into the low-pressure column.

In the process of this invention, the air compressed to the lower pressure is utilized for performing work in an expansion engine, thereby providing make-up refrigeration. However, since in this case there is insufficient reflux liquid available for the low-pressure column, the required amount of reflux liquid is produced in an additional fractionation column to which is fed at least part of the air compressed to the lower pressure. A nitrogen-enriched, liquid fraction formed in the upper part of the additional column is withdrawn and fed as reflux to the low-pressure column. Suitably, a double rectifying column with a high-pressure stage and a low-pressure stage is employed for the air fractionation.

By the process of this invention, it is possible to obtain almost an optimum adaptation of the rectifying conditions in the low-pressure stage to the equilibrium curve, resulting in the minimization of the energy requirement.

According to an advantageous embodiment of the process of this invention, wherein the entire partial stream compressed to the lower pressure is introduced into the additional fractionating column, a gaseous stream corresponding in quantity to the partial stream is withdrawn from the additional fractionating column at least one plate above the feed point of the partial stream and conducted to the engine expansion. Preferably, this withdrawal takes place two plates above the feed point. In this way, hydrocarbons and carbon dioxide contained in the air are removed.

Small traces of hydrocarbons and $CO_2$ are always withdrawn from the cold end of the air-cooling heat exchanger system (reversing heat-exchangers or regenerators). These traces are dissolved in the column-reflux; one partial stream of the air (the stream with the higher pressure) is fed into the high-pressure column and the traces are dissolved in the bottom-liquid-fraction of this column. This fraction is purified from these traces by silicagel adsorbers installed in the liquid-fraction-line from the high pressure column to the low pressure column.

The traces in the other stream (lower pressure stream) are dissolved in the additional column and purified in gel-adsorbers in the line for the bottom liquid-fraction of this additional column.

The traces in the third stream which is fed into the expansion engine can be simultaneously dissolved in the bottom-liquid-fraction of the additional column if this third stream is first fed into the additional column and then withdrawn from this column above the feed point. In this way it is possible to avoid a silicagel-adsorber in the third stream from the revex to the expansion turbine; such an adsorber in the gasphase-line has the disadvantage of a high pressure drop.

It has proven to be suitable in a further development of the present invention, for the partial stream compressed to the lower pressure and fed to the low-pressure stage to be warmed prior to its expansion in the separate heat exchange units in heat exchange with the two air streams to be fractionated.

To take into account simultaneously the conditions for warming the turbine air on the one hand, and the sublimation conditions on the cold end of the heat-exchange units on the other hand, the partial stream compressed to the lower pressure, in an advantageous embodiment of the present invention, is compressed to a pressure of more than 2.5 bar, e.g. 2.5–4.5 bar. It has proven to be especially advantageous if the pressure is about 3.5 bar. Conversely, the pressure in the high pressure column is generally higher, by about 4 to 8 bar, than in the low pressure column.

According to a modification of the present invention, the sump liquid, enriched in oxygen, is withdrawn from the additional fractionating column, warmed up, at least partially evaporated during this step, and the evaporated proportion is fed to to the low-pressure column. It is advantageous if, in a further embodiment of the invention, the warming of the sump liquid takes place in a heat exchanger in the head of the additional fractionating column, during which step nitrogen is simultaneously condensed in the head of this column.

Preferred apparatus for conducting the process of this invention comprises a two-stage air compressor; two separate heat-exchange units, each of which is in communication with the outlet of a compressor stage; a two-stage rectifying column, the high-pressure stage of which is in communication with the second compressor stage; a supplemental fractionating column in communication with the first compressor stage; an expansion engine, the inlet of which is in communication with the first compressor stage and/or with the supplemental fractionating column, and the outlet of which is in communication with the low-pressure stage of the double rectification column; as well as a discharge conduit for liquid nitrogen from the supplemental fractionating column, terminating in the head of the low-pressure column of the double rectification column. (The terms "additional" and "supplemental" are used interchangeably to describe the column operating at a pressure between the high and low pressure columns, generally at 1 to 3 bars above the low pressure column.)

It is advantageous to provide that the apparatus of this invention moreover contains separate warm-up passages in the heat-exchange units for the gas fed to the expansion engine, as well as a valved bypass conduit for the warm-up passages.

DETAILED DESCRIPTION OF THE DRAWINGS

Figure 1:
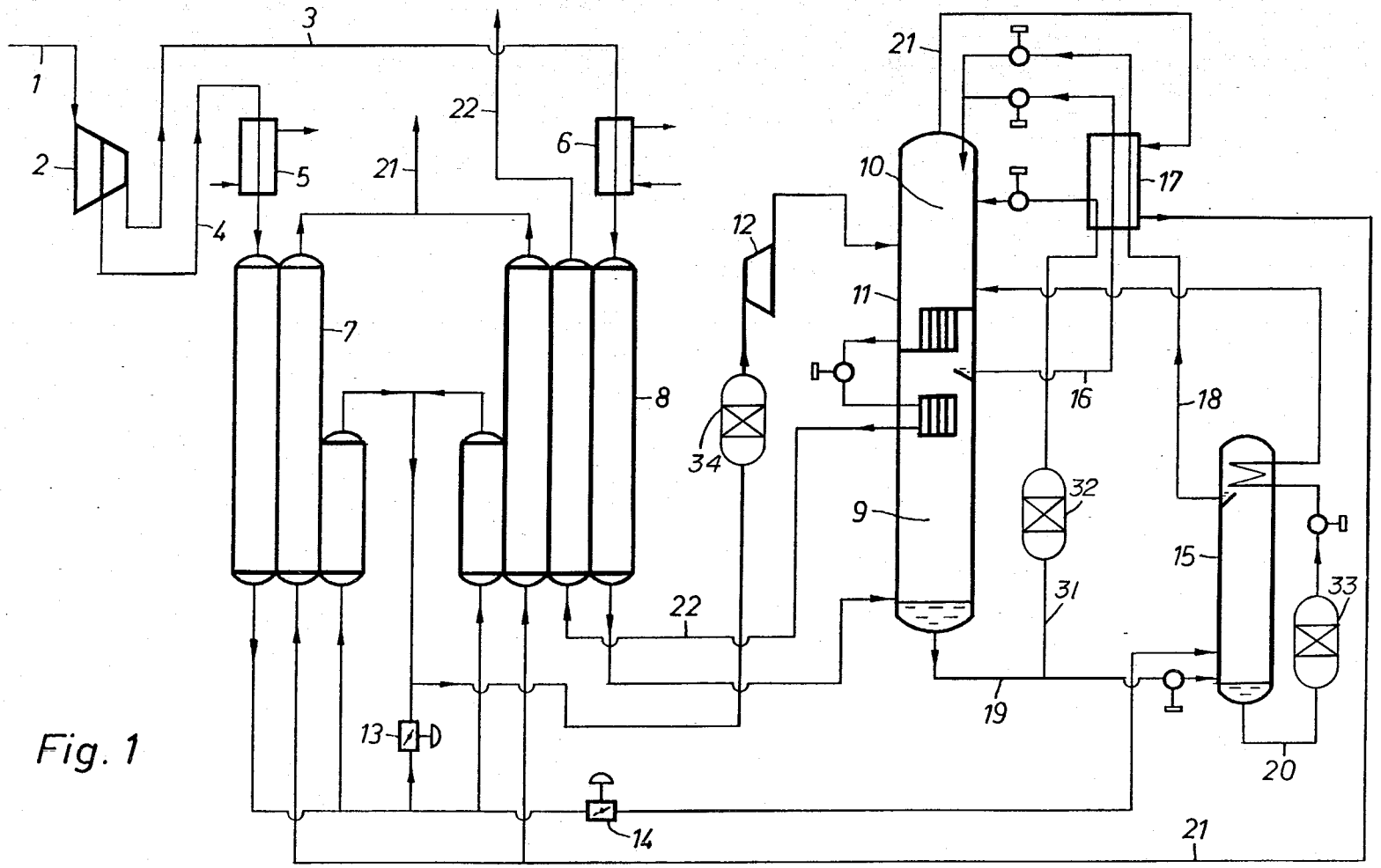
FIG. 1 is a schematic illustation of a plant embodying a large-scale air fractionation process for obtaining 95% oxygen.

The air fractionation plant illustrated in FIG. 1 serves for the manufacture of large amounts of 95% oxygen, i.e. more than 30,000 $Nm^3/h$. of gaseous oxygen. The air entering at 1 is fed to a two-stage compressor 2 wherein a portion 3 of the air (about 60%) is compressed to a pressure of 5.3 bar, while the remainder 4 of the air is compressed to a pressure of 3.5 bar. Both partial streams are initially precooled (heat exchangers 5 and 6), then cooled in two separate heat-exchange units 7 and 8 in heat exchange with fractionation products, wherein high-boiling impurities are congealed. The heat-exchange units 7 and 8 can be regenerators or reversing exchangers.

After leaving the heat-exchange unit, the more highly compressed air stream is introduced into the high-pressure stage 9, operated at a pressure of 5.0 bar, pertaining to a double rectification column 11.

The less highly compressed air stream 4, after cooling is split. The largest part thereof (corresponding to 30% of the entrance air) is conducted via warm-up passages of the heat-exchange units 7 and 8 and via silica gel adsorber 34 for removal of traces of carbon dioxide and hydrocarbons, and then fed to a turbine 12 wherein it is engine-expanded and then fed to the low-pressure stage 10, operated at a pressure of 1.5 bar. In the warm-up passages, the air is prewarmed to the temperature required for an optimum operation of the turbine 12. At the same time, it is possible to meet, by means of this arrangement, the sublimation conditions on the cold ends of the regenerators or reversing exchangers 7, 8. With the aid of a switching valve 13, by means of which a bypass conduit for the warm-up passages can be opened, the design requirements can be fulfilled.

A smaller portion of the less highly compressed air (about 10% of the entrance air)—the proportion can be adjusted with the aid of a switching valve 14—is fed to the supplemental fractionating column 15 operated at a pressure of about 3.2 bar. In the head of the high-pressure stage 9, a nitrogen-enriched fraction is condensed on a condenser-evaporator arranged between the high-pressure stage 9 and the low-pressure stage 10; this fraction is withdrawn via conduit 16, cooled in a heat exchanger 17 against nitrogen from the low-pressure stage, expanded, and introduced into the head of the low-pressure stage 10 as reflux liquid. The reflux quantity corresponds to 28.5% of the entering amount of air.

To ensure a sufficient supply of reflux liquid for the low-pressure stage 10, so that the oxygen content in the nitrogen being withdrawn is no more than about 1%, the invention provides for the withdrawal of a nitrogen-enriched condensate 18 (corresponding to 5% of the entrance air), from the head of the supplemental fractionating column. This fraction is further cooled in heat exchanger 17, and introduced as reflux into the low-pressure stage 10. Oxygen-enriched liquid which condenses in the sump of the high-pressure stage is withdrawn via a conduit 19—the quantity withdrawn corresponds to 31.5% of the entrance air—and after being branched into two streams, the largest part (corresponding to 26.5% of the entrance air) is passed via line 31 containing silica gel adsorber 32 for removal of trace amounts of carbon dioxide and hydrocarbons; the resultant stream is cooled in heat exchanger 17 and then fed to the low-pressure stage 10. The remaining part of the withdrawn sump liquid from the high pressure stage is introduced into the sump of the supplemental fractionating column 15, from which the thus-formed sump liquid is likewise withdrawn (conduit 20) and purified in silica gel adsorber to remove carbon dioxide and hydrocarbons. This withdrawn sump liquid from the supplemental column is evaporated in a heat exchanger in the head of the supplemental fractionating column 15 under a pressure of about 1.4 bar in heat exchange with condensing nitrogen, and fed to the low-pressure stage. This partial stream, containing about 40% oxygen, corresponds to 10% of the entering air.

Gaseous nitrogen is withdrawn from the head of the low-pressure stage via a conduit 21, warmed in heat exchanger 17, and removed from the plant via the heat-exchange units 7 and 8. Liquid product oxygen having a purity of 95% is withdrawn from the sump of the low-pressure stage 10 and evaporated in a heat exchanger in the head of the high-pressure stage 9, wherein simultaneously nitrogen is condensed on the outside of the heat exchanger.

By way of the heat-exchanger unit 8 and conduit 22, the oxygen is discharged from the plant. By means of the process described herein, 21 parts of oxygen are obtained from 100 parts of air, corresponding to an air factor of just about 5. (Air factor is defined as the ratio of the amount of incoming air to product oxygen.) Since the purity of the product oxygen is smaller than 100%, e.g. 95% $O_2$ with 5% argon and nitrogen, an air factor of 5 can be gained.

Table 1 is a compilation of additional numerical data for further elucidation of the advantages of this invention. The data refer to processes for the production of oxygen having a purity of 98 and 99.5%, respectively, with a plant output of more than 30,000 $Nm^3/h$. of oxygen in the gaseous phase.

TABLE 1

| | | |
|---|---|---|
| Oxygen purity | 98% | 99.5% |
| Air quantity about 6 bar | 70% | 80% |
| Air quantity 3.5 bar | 30% | 20% (to 4.2 bar) |
| Air factor | 5.1 | 5.3 |

Table 2 compares the energy requirement values for the process of this invention with an air factor of 5.0 of a production of 95% oxygen and 98% oxygen, respectively.

TABLE 2

| | | | |
|---|---|---|---|
| Oxygen purity | 95% | 98% | |
| Air quantity 5.3 bar | 60% | 70% | (5.8 bar) |
| Air quantity 3.5 bar | 40% | 30% | |
| Energy requirement (in $kWh/Nm^3\ O_2$) | 0.357 | 0.373 | (with $\eta_{compressor}$ = 72%) |
| | 0.321 | 0.344 | (with $\eta_{compressor}$ = 78%) |

Wherein $\eta_{compressor}$, referring to both production percentages, is the degree of efficiency of the two-stage compressor 2.

The energy requirement values for a process of the conventional type are about 0.41 $KWh/Nm^3\ O_2$. Even though the reduction gained by a process according to the invention seems to be small, the energy costs can be considerably reduced.

Since, for example, the power requirement of a plant of 60,000 $Nm^3/h$. of gaseous oxygen is 25 megawatts, considerable reductions in expenditure can be attained even with small percentage savings.

Figure 2:
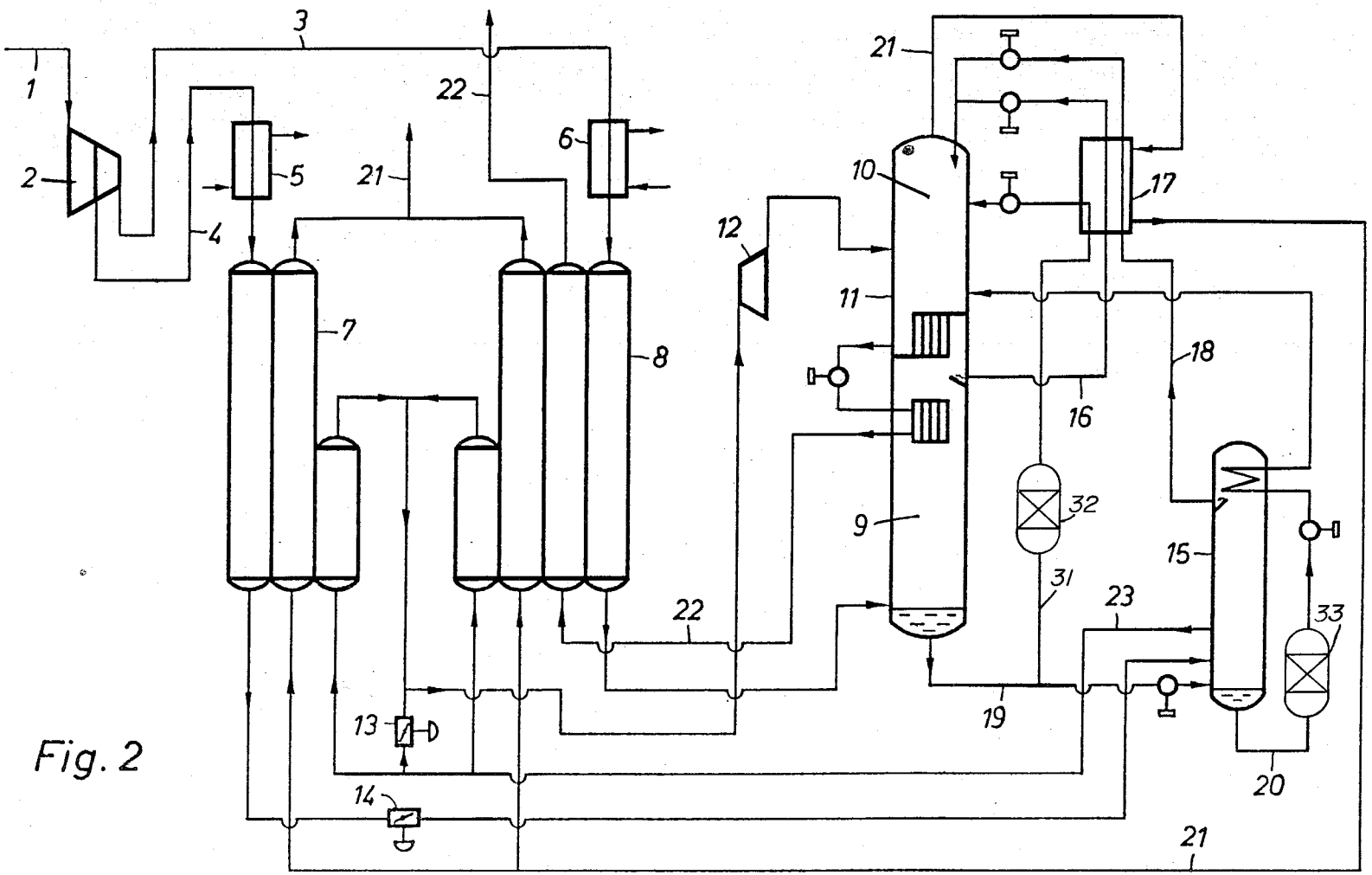
FIG. 2 shows a modified embodiment of the process according to FIG. 1.

FIG. 2 shows a modification of the process of this invention wherein the entire partial stream 4 of the air compressed to the lower pressure is introduced into the supplemental fractionating column 15, and, above the feed point, an air stream quantitatively of the same size is withdrawn via conduit 23. Preferably the air is conducted prior to withdrawal through two plates of the further fractionating column 15. In this way, hydrocarbons and carbon dioxide are removed from the air, before the air is expanded in the turbine 12 and fed to the low-pressure stage 10. Otherwise, in this embodiment which does not utilize silica gel adsorber 34 of FIG. 1, the hydrocarbons and carbon dioxide would concentrate in the sump of the low-pressure stage 10 and lead to an obstruction or even an explosion of the evaporator located in the sump.

The air in conduit 23 is fed to the turbine 12 for expansion purposes, partially by way of the warm-up passages of the heat-exchange units 7, 8 and partially, depending on the position of the switching valve 13, with bypass of the warm-up passages. Otherwise, the process is identical to the process illustrated in FIG. 1.

Figure 3:
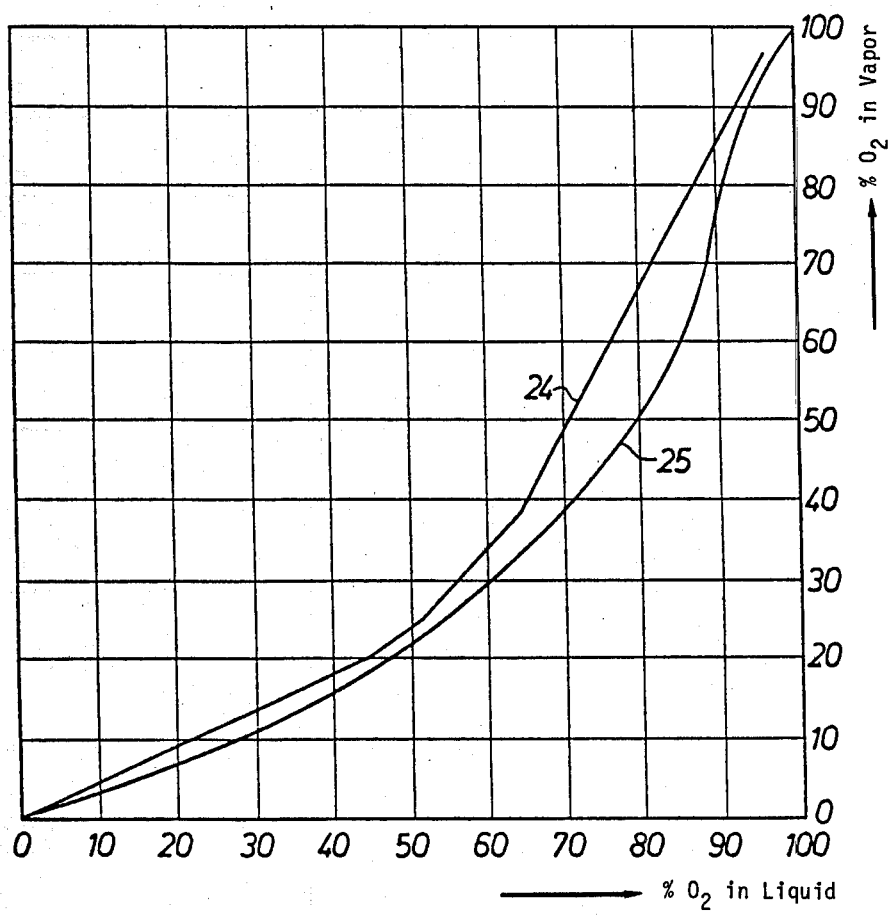
FIG. 3 is a diagram showing the rectification curve in the low-pressure column.

In FIG. 3, the course of the rectification in the low-pressure stage 10 is shown graphically in a McCabe-Thiele diagram when producing 95% oxygen. The abscissa shows the percentage proportion of oxygen in the liquid; the ordinate shows the percentage proportion of oxygen in the vapor. The actual course of the rectification (curve 24) is very close to the ideal equilibrium curve 25.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for obtaining oxygen from air by low-temperature rectification in a double rectification column comprising a high-pressure column and a low-pressure column, said process comprising compressing the air to be fractionated into higher and lower pressure partial streams; cooling said partial streams in indirect heat exchange with a nitrogen-enriched gaseous stream from the rectification column; and introducing the partial stream of the air to be fractionated which has been compressed to the higher pressure into the lower part of the high pressure column, the improvement which comprises passing at least a part of the partial stream of the air to be fractionated which has been compressed to the lower pressure to a supplemental fractionating column operating at between the pressure ambient in the high-pressure column and the pressure ambient in the low-pressure column, withdrawing from said supplemental column a nitrogen-enriched liquid, passing the latter as reflux to the low-pressure column, said supplemental fractionating column operating at 1–3 bars above the pressure of the low-pressure column, engine expanding at least one of (a) the remaining portion of the partial stream compressed to the lower pressure, and (b) a gaseous stream withdrawn from the supplemental fractionating column; and introducing resultant engine expanded fluid in a substantially gaseous phase into the low-pressure column.

2. A process according to claim 1, characterized in that the partial stream compressed to the lower pressure and fed to the low-pressure column is warmed, prior to engine expansion, in separate heat-exchange units in indirect heat exchange with the higher pressure and lower pressure air streams to be fractionated.

3. A process according to claim 1, wherein the partial stream compressed to the lower pressure is compressed to a pressure of more than 2.5 bar.

4. A process according to claim 1, further comprising withdrawing oxygen-enriched sump liquid from the supplemental fractionation column, at least partially evaporating said sump liquid, and feeding the evaporated portion to the low-pressure column.

5. A process according to claim 4, wherein the evaporation of the sump liquid of the supplemental column is conducted in a heat exchanger in the head of said column.

6. In an apparatus for conducting a process for obtaining oxygen from air by low-temperature rectification, comprising a two-stage air compressor (2); two separate heat-exchange units (7,8), each of which is in communication with the outlet of a compressor stage; and a double rectification column (11), the high-pressure stage (9) of which is in communication with the second compressor stage, the improvement which comprises a supplemental fractionating column (15) in communication with the first compressor stage; an expansion engine (12), the inlet of which is in communication with the first compressor stage and/or with the supplemental fractionating column (15), and the outlet of which is in communication with the low-pressure stage (10) of the double rectification column (11); as well as a discharge conduit (18) for liquid nitrogen from the supplemental fractionating column (15), terminating in the head of the low-pressure stage (10) of the double rectification column (11).

7. Apparatus according to claim 6, further comprising separate warm-up passages in the heat-exchange units (7,8) for the gas fed to the expansion engine (12), and a valved bypass conduit for the warm-up passages.

8. A process according to claim 1, wherein the partial stream compressed to the lower pressure is compressed to a pressure of 2.5–4.5 bar.

9. A process according to claim 1, wherein the partial stream compressed to the lower pressure is compressed to a pressure of 3.5 bar.

10. A process according to claim 1, wherein said high pressure column is operating at 4–8 bar above the pressure of the low pressure column.

11. In a process for obtaining oxygen from air by low-temperature rectification in a double rectification column comprising a high-pressure column and a low pressure column, said process comprising compressing the air to be fractionated into higher and lower pressure partial streams; cooling said partial streams in indirect heat exchange with a nitrogen-enriched gaseous stream from the rectification column; and introducing the partial stream of the air to be fractionated which has been compressed to the higher pressure into the lower part of the high pressure column, the improvement which comprises passing the entire partial stream of the air to be fractionated which has been compressed to the lower pressure to a supplemental fractionating column operating at between the pressure ambient in the high-pressure column and the pressure ambient in the low-pressure column, withdrawing a nitrogen-enriched liquid from said supplemental column, passing the withdrawn nitrogen-enriched liquid as reflux to the low-pressure column, said supplemental fractionating column operating at 1–3 bars above the pressure of the low-pressure column, withdrawing a gaseous stream corresponding in quantity to said entire partial stream from the supplemental fractionation column at least one plate above the feed point of the entire partial stream, and engine expanding the withdrawn gaseous stream.

12. A process according to claim 11, wherein said high pressure column is operating at 4–8 bar above the pressure of the low pressure column.

13. In a process for obtaining oxygen from air by low-temperature rectification in a double rectification column comprising a high-pressure stage and a low-pressure stage, said process comprising compressing the air to be fractionated and cooling resultant compressed gas in a heat-exchange with rectification products, passing a first partial air flow into the high-pressure stage and passing a second partial air flow at least in part into supplemental fractionating column operated at a pressure lower than the high-pressure stage and from which an oxygen-rich liquid is passed to the low-pressure stage, the improvement wherein the second partial flow is compressed to a lower pressure than the first partial flow, and part of the second partial flow and/or a gas flow removed from the supplemental fractionating column is engine expanded and passed in essentially gaseous form to the low-pressure stage.

14. A process according to claim 13, wherein the partial flows following the respective compression steps are cooled separately from one another.

15. In a process for obtaining oxygen from air by low-temperature rectification in a double rectification column comprising a high-pressure column and a low-pressure column, said process comprising separating the air to be fractionated into a first and a second partial stream of differing pressures, said first and second partial streams having been compressed into respective higher and lower pressure partial streams, cooling said first and second partial streams in separate heat-exchange units in indirect heat exchange with a nitrogen-enriched gaseous stream from the rectification column, and introducing the first partial stream of air which has been compressed to the higher pressure into the lower part of the high pressure column, the improvement which comprises introducing a part of the second partial stream of air which has been compressed to the lower pressure into a supplemental fractionating column operating at between the pressure ambient in the high pressure column and the pressure ambient in the low pressure column, withdrawing from said supplemental column a nitrogen-enriched liquid, and passing the latter as reflux to the low-pressure column, and engine expanding the other part of the second partial stream of air which has been compressed to the lower pressure and introducing said other part of the second partial stream in a substantially gaseous phase into the low-pressure column.

16. A process according to claim 15, wherein said supplemental fractionating column is operating at 1–3 bars above the pressure of the low-pressure column.

17. A process according to claim 15, wherein the partial stream compressed to the lower pressure is compressed to a pressure of 2.5–4.5 bar.

18. A process according to claim 15, wherein the partial stream compressed to the lower pressure is compressed to a pressure of 3.5 bar.

19. A process according to claim 15, wherein said high pressure column is operating at 4–8 bar above the pressure of the low pressure column.

* * * * *